US011534931B2

(12) United States Patent
Werner

(10) Patent No.: US 11,534,931 B2
(45) **Date of Patent: *Dec. 27, 2022**

(54) BLADE ASSEMBLY HAVING ENTRAPPED SPRING

(71) Applicant: Andis Company, Sturtevant, WI (US)

(72) Inventor: Edwin A. Werner, Union Grove, WI (US)

(73) Assignee: Andis Company, Sturtevant, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/085,473

(22) Filed: Oct. 30, 2020

(65) Prior Publication Data

US 2021/0046661 A1 Feb. 18, 2021

Related U.S. Application Data

(63) Continuation of application No. 16/399,023, filed on Apr. 30, 2019, now Pat. No. 10,850,407, which is a (Continued)

(51) Int. Cl.

| | |
|---|---|
| ***B26B 19/06*** | (2006.01) |
| ***B26B 19/38*** | (2006.01) |
| ***B26B 19/20*** | (2006.01) |

(52) U.S. Cl.

CPC ..... *B26B 19/06* (2013.01); *B26B 19/063* (2013.01); *B26B 19/205* (2013.01); *B26B 19/3846* (2013.01)

(58) Field of Classification Search

CPC ..... B26B 19/02; B26B 19/04; B26B 19/046; B26B 19/048; B26B 19/06; B26B 19/063; (Continued)

(56) References Cited

U.S. PATENT DOCUMENTS

| | | | |
|---|---|---|---|
| 1,701,148 | A | 2/1929 | Dremel |
| 1,729,332 | A | 9/1929 | Dremel |

(Continued)

FOREIGN PATENT DOCUMENTS

| | | |
|---|---|---|
| CN | 203460208 | 3/2014 |
| CN | 203650556 | 6/2014 |

(Continued)

OTHER PUBLICATIONS

State Intellectual Property Office of China, "First Office Action," issued in connection with Chinese Patent Application No. 201510593985.8, dated Mar. 6, 2018, 10 pages.

(Continued)

*Primary Examiner* — Evan H MacFarlane

(74) *Attorney, Agent, or Firm* — Reinhart Boerner Van Deuren s.c.

(57) ABSTRACT

A blade assembly for a hair cutting apparatus includes a first blade having teeth extending along a first blade edge, and a second blade having teeth extending along a second blade edge. A distance between the first and second blade edges defines a blade gap. A yoke is coupled to the second blade and configured to convert motion of a drive into reciprocation of the second blade relative to the first blade to cut hair. A spring includes a spring base and at least one spring arm configured to reciprocate with the second blade. A guide assembly includes a guide and a spring retainer, the guide being positioned between the first blade and the second blade, and the spring retainer fixing the spring base relative to the first blade, wherein in response to moving the guide relative to the first blade, the blade gap changes.

19 Claims, 4 Drawing Sheets

Related U.S. Application Data continuation of application No. 15/683,265, filed on Aug. 22, 2017, now Pat. No. 10,322,517, which is a continuation of application No. 14/489,159, filed on Sep. 17, 2014, now Pat. No. 9,770,836.

(58) Field of Classification Search

CPC ..... B26B 19/066; B26B 19/20; B26B 19/205; B26B 19/3846

USPC ..... 30/195, 208, 210, 196, 200, 201, 223, 30/43.91, 43.92

See application file for complete search history.

(56) References Cited

U.S. PATENT DOCUMENTS

| | | | | |
|---|---|---|---|---|
| 2,306,039 | A | 12/1942 | Cromonic | |
| 2,790,236 | A | 4/1957 | Andis | |
| 2,928,171 | A | 3/1960 | Oster | |
| 3,242,570 | A | 3/1966 | Eduard | |
| 3,589,007 | A | 6/1971 | Walton | |
| 3,747,212 | A * | 7/1973 | Krayl | B26B 19/06 30/223 |
| 4,249,307 | A * | 2/1981 | Andis | B26B 19/3846 30/216 |
| 4,825,546 | A | 5/1989 | Araki et al. | |
| 5,068,966 | A | 12/1991 | Wahl et al. | |
| 5,909,929 | A | 6/1999 | Chen | |
| 6,260,276 | B1 | 7/2001 | Lebherz et al. | |
| 6,308,415 | B1 | 10/2001 | Sablatschan | |
| 6,421,922 | B2 | 7/2002 | Beutel et al. | |
| 6,502,312 | B2 | 1/2003 | Beutel et al. | |
| 7,080,458 | B2 | 7/2006 | Andis | |
| 7,703,210 | B2 | 4/2010 | Lau | |
| 8,079,149 | B2 | 12/2011 | Bednar | |
| 9,770,836 | B2 | 9/2017 | Werner | |
| 10,322,517 | B2 | 6/2019 | Werner | |
| 2002/0014010 | A1 | 2/2002 | Beutel | |
| 2002/0092178 | A1 | 7/2002 | Fung | |
| 2006/0042096 | A1 | 3/2006 | Liao | |
| 2007/0193034 | A1 | 8/2007 | Oh | |
| 2008/0282550 | A1 | 11/2008 | Piwaron | |
| 2009/0144988 | A1 | 6/2009 | Lau | |
| 2010/0000093 | A1 | 1/2010 | Hwang | |
| 2011/0119929 | A1 | 5/2011 | Lau | |
| 2011/0265331 | A1 | 11/2011 | Moseman | |
| 2012/0144679 | A1 | 6/2012 | Hwang | |
| 2012/0272532 | A1 | 11/2012 | Sobagaki et al. | |
| 2013/0192068 | A1 | 8/2013 | Kammer et al. | |
| 2014/0259689 | A1 | 9/2014 | Lau | |
| 2014/0338199 | A1* | 11/2014 | Erickson | B26B 19/3846 30/216 |
| 2015/0367521 | A1 | 12/2015 | Toy | |
| 2016/0279813 | A1 | 9/2016 | Buck, Jr. et al. | |
| 2017/0348865 | A1 | 12/2017 | Werner | |
| 2019/0232509 | A1 | 8/2019 | Werner | |

FOREIGN PATENT DOCUMENTS

| | | |
|---|---|---|
| DE | 814117 | 9/1951 |
| DE | 19708145 | 8/1998 |
| EP | 0447131 | 9/1991 |
| GB | 2410457 | 8/2005 |

OTHER PUBLICATIONS

Andis, "Andis Outliner Trimmer Replacement Blade Set," [http://www.amazon.com/Andis-Outliner-Trimmer-Replacement-Blade/dp/B000A3WXPC], May 29, 2010.

European Patent Office, "Extended European Search Report," issued in connection with European Patent Application No. 15185460.1, dated Feb. 10, 2016, 9 pages.

International Search Report and Written Opinion for PCT/US2020/024955 dated Jul. 14, 2020, 14 pages.

* cited by examiner

BLADE ASSEMBLY HAVING ENTRAPPED SPRING

CROSS-REFERENCE TO RELATED PATENT APPLICATIONS

This application is a continuation of U.S. patent application Ser. No. 16/399,023, filed Apr. 30, 2019, which is a continuation of U.S. application Ser. No. 15/683,265, now U.S. Pat. No. 10,322,517, filed on Aug. 22, 2017, which is a continuation of U.S. patent application Ser. No. 14/489,159, now U.S. Pat. No. 9,770,836, filed on Sep. 17, 2014, each of which is incorporated herein by reference in its entirety.

BACKGROUND OF THE INVENTION

The present invention relates to a blade assembly for a hair cutting apparatus.

SUMMARY OF THE INVENTION

In one construction, the invention provides a blade assembly for a hair cutting apparatus, the blade assembly comprising: a first blade having teeth extending along a first blade edge; a second blade positioned proximate the first blade, the second blade having teeth extending along a second blade edge parallel to the first blade edge and offset from the first blade edge by a blade gap; a yoke coupled to the second blade, the yoke adapted to convert motion of a drive mechanism into reciprocation of the second blade with respect to the first blade to cut hair between the teeth of the first and second blades; a spring having a spring base and at least one spring arm coupled to one of the yoke and second blade, the spring arm reciprocating with the second blade with respect to the first blade; and a spring retainer mounted to the first blade and fixing the spring base with respect to the first blade to prevent relative movement between the spring base and the first blade during reciprocation of the second blade and spring arm with respect to the first blade; wherein the spring arm applies a biasing force on the second blade toward the first blade to maintain the first and second blades in an operational condition when separated from the hair cutting apparatus.

In some constructions the blade assembly further comprises a guide secured to the first blade and sandwiched between the first and second blades, the guide restricting movement of the second blade perpendicular to the first blade edge to maintain a desired blade gap. In some constructions the blade assembly further comprises a slot in the guide; and a fastener secured to the first blade and extending through the slot; wherein the blade gap is adjustable by moving the guide within a range of adjustability defined by the fastener abutting opposite ends of the slot; wherein a desired blade gap is achieved by tightening the fastener to fix the guide to the first blade with the guide in a position corresponding to the desired blade gap. In some constructions the spring and second blade are movable with the guide, such that the first and second blades are maintained in the operational condition during adjustment of the blade gap. In some constructions the spring retainer includes a portion of the guide, such that the guide serves a first purpose of maintaining the desired blade gap and a second purpose of fixing the spring base with respect to the first blade. In some constructions the guide is T-shaped, having a guide base extending perpendicular to the first blade edge and a cross portion extending parallel to the first blade edge; wherein the guide base includes the spring retainer. In some constructions the spring base is held against the first blade by the spring retainer; and wherein the spring arm includes a fixed end integral with the spring base and a free end coupled to one of the yoke and second blade; wherein the spring arm pivots about the fixed end during reciprocation of the second blade; and wherein neither the spring base nor the spring arm includes a compliance coil to accommodate reciprocation of the second blade.

In another construction, the invention provides a blade assembly for a hair cutting apparatus, the blade assembly comprising: a first blade having teeth extending along a first blade edge; a second blade positioned proximate the first blade, the second blade having teeth extending along a second blade edge parallel to the first blade edge and offset from the first blade edge by a blade gap; a yoke coupled to the second blade, the yoke adapted to convert motion of a drive mechanism into reciprocation of the second blade with respect to the first blade to cut hair between the teeth of the first and second blades; a spring biasing the second blade toward the first blade to maintain the first and second blades in an operational condition when separated from the hair cutting apparatus; a fastener secured to the first blade; and a guide having a slot, the fastener extending through the slot; wherein the blade gap is adjustable by moving the guide within a range of adjustability defined by the fastener abutting opposite ends of the slot; wherein a desired blade gap is achieved by tightening the fastener to fix the guide to the first blade with the guide in a position corresponding to the desired blade gap; wherein the blade gap is adjusted with the spring maintaining the first and second blades in the operational condition while separated from the hair cutting apparatus.

In some constructions the spring includes a spring base and at least one spring arm coupled to one of the yoke and second blade, the spring arm reciprocating with the second blade with respect to the first blade; the blade assembly further comprising a spring retainer mounted to the first blade and fixing the spring base with respect to the first blade to prevent relative movement between the spring base and the first blade during reciprocation of the second blade with respect to the first blade. In some constructions a portion of the guide serves as the spring retainer.

In another construction, the invention provides a blade assembly for a hair cutting apparatus, the blade assembly comprising: a first blade having teeth extending along a first blade edge; a second blade positioned proximate the first blade, the second blade having teeth extending along a second blade edge parallel to the first blade edge; a yoke coupled to the second blade, the yoke adapted to convert motion of a drive mechanism into reciprocation of the second blade with respect to the first blade to cut hair between the teeth of the first and second blades; and a spring having a spring base and at least one spring arm extending from the spring base to one of the yoke and second blade, the spring base being fixed with respect to the first blade, the spring arm including a fixed end integral with the spring base and a free end coupled to one of the yoke and second blade, the spring arm pivoting about the fixed end to accommodate reciprocation of the second blade; wherein neither the spring base nor the spring arm includes a compliance coil to accommodate reciprocation of the second blade.

In some constructions the blade assembly further comprises a guide secured to the first blade and sandwiched between the first and second blades, the guide restricting movement of the second blade perpendicular to the first blade edge to maintain a desired blade gap. In some constructions the blade assembly further comprises a slot in the guide; and a fastener secured to the first blade and extending through the slot; wherein the blade gap is adjustable by moving the guide within a range of adjustability defined by the fastener abutting opposite ends of the slot; wherein a desired blade gap is achieved by tightening the fastener to fix the guide to the first blade with the guide in a position corresponding to the desired blade gap. In some constructions the spring and second blade are movable with the guide, such that the first and second blades are maintained in an operational condition during adjustment of the blade gap. In some constructions the blade assembly further comprises a spring retainer incorporated into the guide, the spring retainer fixing the spring base with respect to the first blade.

In another construction, the invention provides a blade assembly for a hair cutting apparatus, the blade assembly comprising: a first blade having teeth extending along a first blade edge; a second blade positioned proximate the first blade, the second blade having teeth extending along a second blade edge parallel to the first blade edge and offset from the first blade edge by a blade gap; a yoke coupled to the second blade, the yoke adapted to convert motion of a drive mechanism into reciprocation of the second blade with respect to the first blade to cut hair between the teeth of the first and second blades; a spring having a spring base and at least one spring arm coupled to one of the yoke and second blade, the spring arm reciprocating with the second blade with respect to the first blade, the spring arm applying a biasing force on the second blade toward the first blade; and a guide secured to the first blade and sandwiched between the first and second blades, the guide restricting movement of the second blade perpendicular to the first blade edge to maintain a desired blade gap, the guide being mounted to the first blade and fixing the spring base with respect to the first blade to prevent relative movement between the spring base and the first blade during reciprocation of the second blade with respect to the first blade.

In some constructions the guide traps the spring base against the first blade. In some constructions, the blade assembly further comprises a slot in the guide; and a fastener secured to the first blade and extending through the slot; wherein the blade gap is adjustable by moving the guide within a range of adjustability defined by the fastener abutting opposite ends of the slot; wherein a desired blade gap is achieved by tightening the fastener to fix the guide to the first blade with the guide in a position corresponding to the desired blade gap. In some constructions the spring and second blade are movable with the guide, such that the first and second blades are maintained in an operational condition during adjustment of the blade gap with the blade assembly separated from the hair cutting apparatus.

In another construction, the invention provides a method for adjusting a blade gap of a blade assembly for a hair cutting apparatus, the blade assembly including first and second blades having parallel blade edges separated by the blade gap, a spring maintaining the first and second blades in an operational condition, and a spring retainer fixing a portion of the spring to the first blade, the method comprising: removing the blade assembly from the hair cutting apparatus; with the first and second blades in the operational condition, moving the spring retainer and spring perpendicular to the blade edges; and in response to moving the spring retainer and spring, moving the second blade with respect to the first blade to adjust the blade gap while maintaining the first and second blades in the operational condition.

In another construction, the blade assembly for a hair cutting apparatus includes a first blade having teeth extending along a first blade edge, and a second blade having teeth extending along a second blade edge parallel to the first blade edge. A distance between the first and second blade edges defines a blade gap. A yoke is coupled to the second blade and configured to convert motion of a drive into reciprocation of the second blade relative to the first blade to cut hair. A spring includes a spring base and at least one spring arm configured to reciprocate with the second blade. A guide assembly includes a guide and a spring retainer, the guide being positioned between the first blade and the second blade, and the spring retainer fixing the spring base relative to the first blade, wherein in response to moving the guide relative to the first blade, the blade gap changes.

In another construction, the blade assembly for a hair cutting apparatus includes a first blade having teeth extending along a first blade edge, a second blade having teeth extending along a second blade edge, a distance between the first blade edge and the second blade edge defining a blade gap. A biasing member is configured to apply a biasing force on the second blade towards the first blade, and a guide includes a guide base and a cross portion, the cross portion positioned between the first blade and the second blade, the guide configured to move the second blade relative to the first blade to change the blade gap, and the second blade configured to reciprocate relative to the cross portion of the guide.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
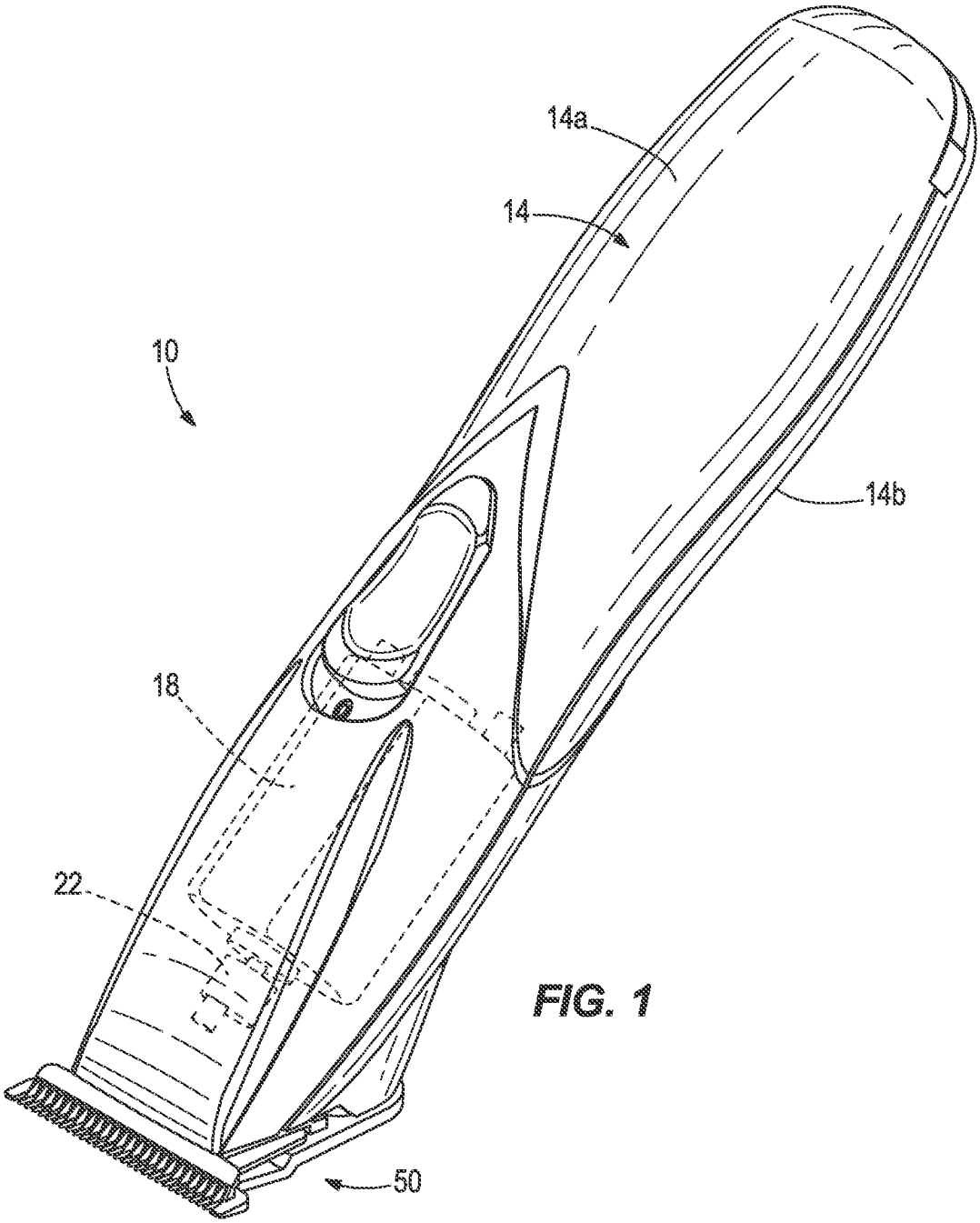
FIG. 1 is a perspective view of a hair cutting apparatus incorporating a blade assembly according to the present invention.
Figure 2:
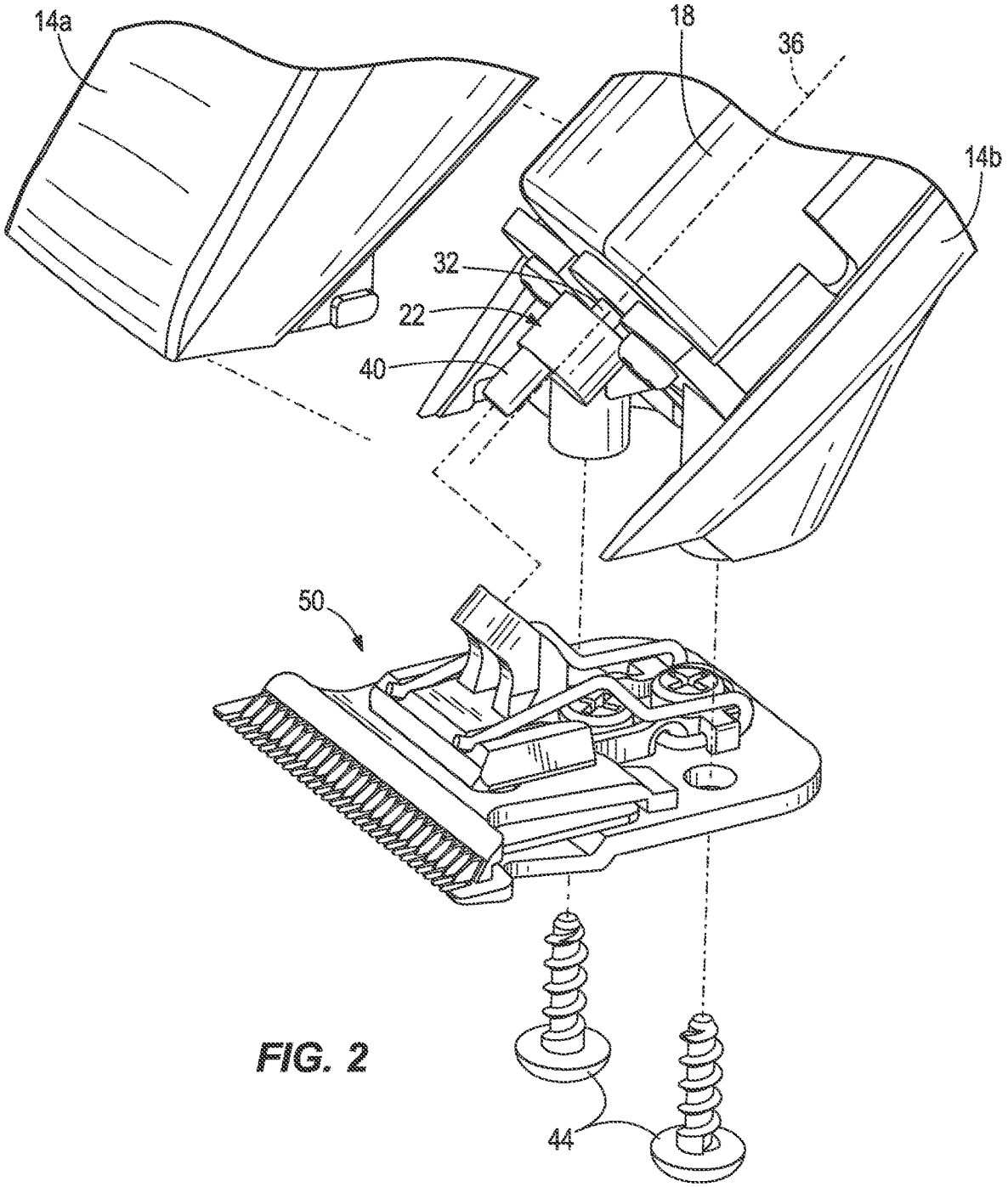
FIG. 2 is a partially exploded view with the blade assembly removed from rest of the hair cutting apparatus.

FIGS. 1 and 2 illustrate a hair cutting apparatus 10, such as a trimmer or clipper, having a housing 14, an electric motor 18, a drive mechanism 22, and a blade assembly 50. The housing 14 may be a clamshell configuration as illustrated, with top and bottom portions 14*a*, 14*b* that surround the motor 18 and drive mechanism 22, or can be in any other suitable configuration. The electric motor 18 can operate with power from batteries or electricity from an outlet, and includes a rotating motor output shaft 32 that rotates about an axis of rotation 36. The drive mechanism 22 includes an eccentric drive 40 that is offset from the axis of rotation 36 of the motor output shaft 32. The blade assembly 50 is secured to the hair cutting apparatus housing 14 by way of a pair of housing fasteners 44.

Figure 3:
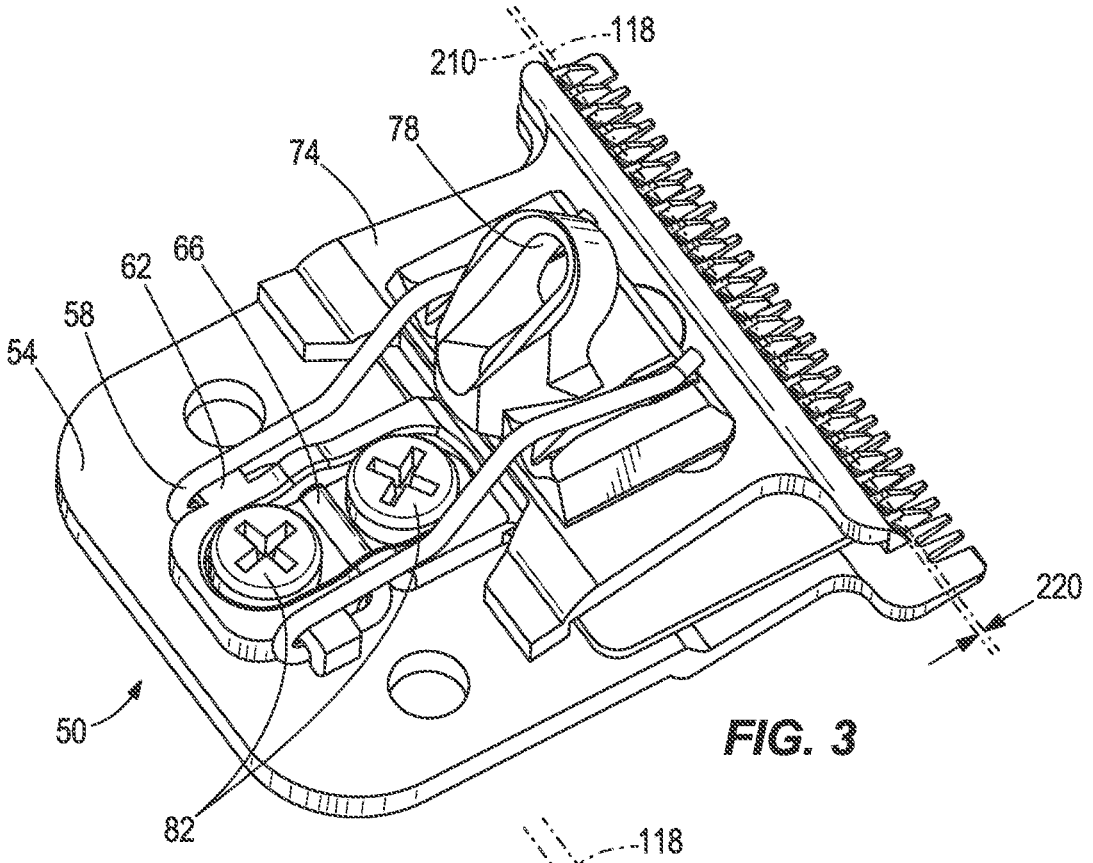
FIG. 3 is perspective view of the blade assembly in a minimum blade gap setting.
Figure 4:
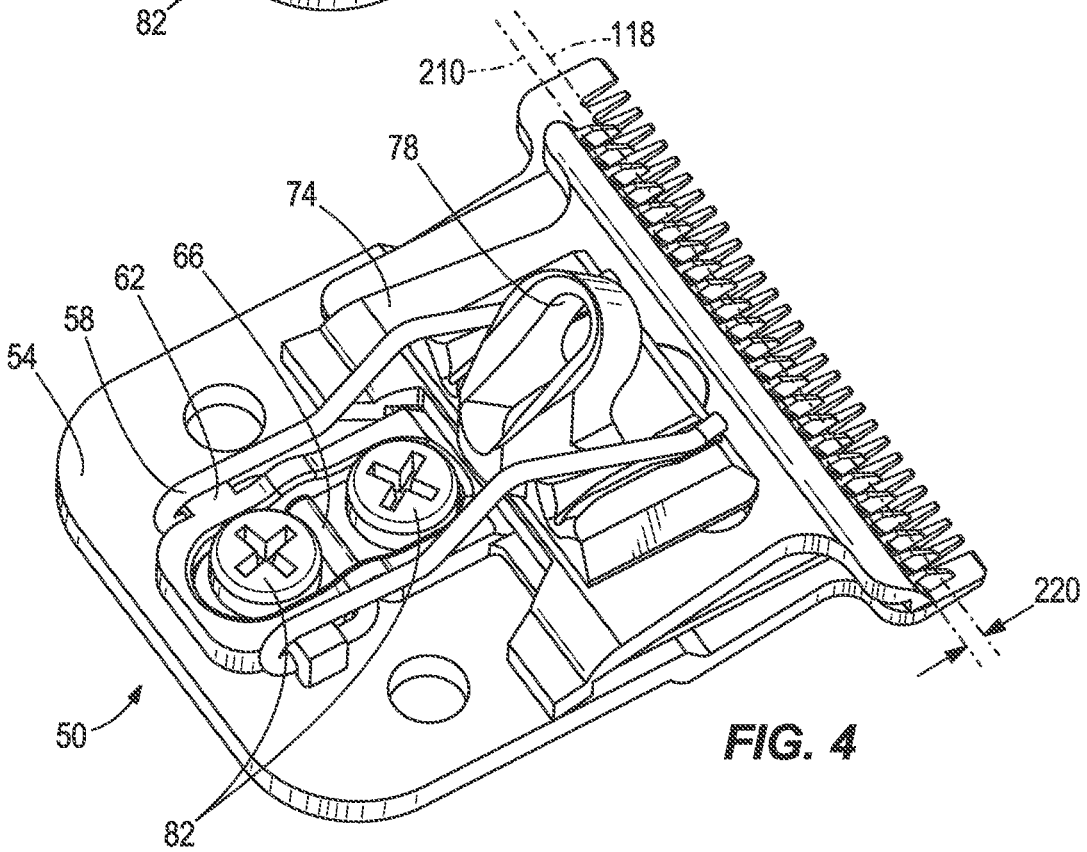
FIG. 4 is a perspective view of the blade assembly in a maximum blade gap setting.
Figure 5:
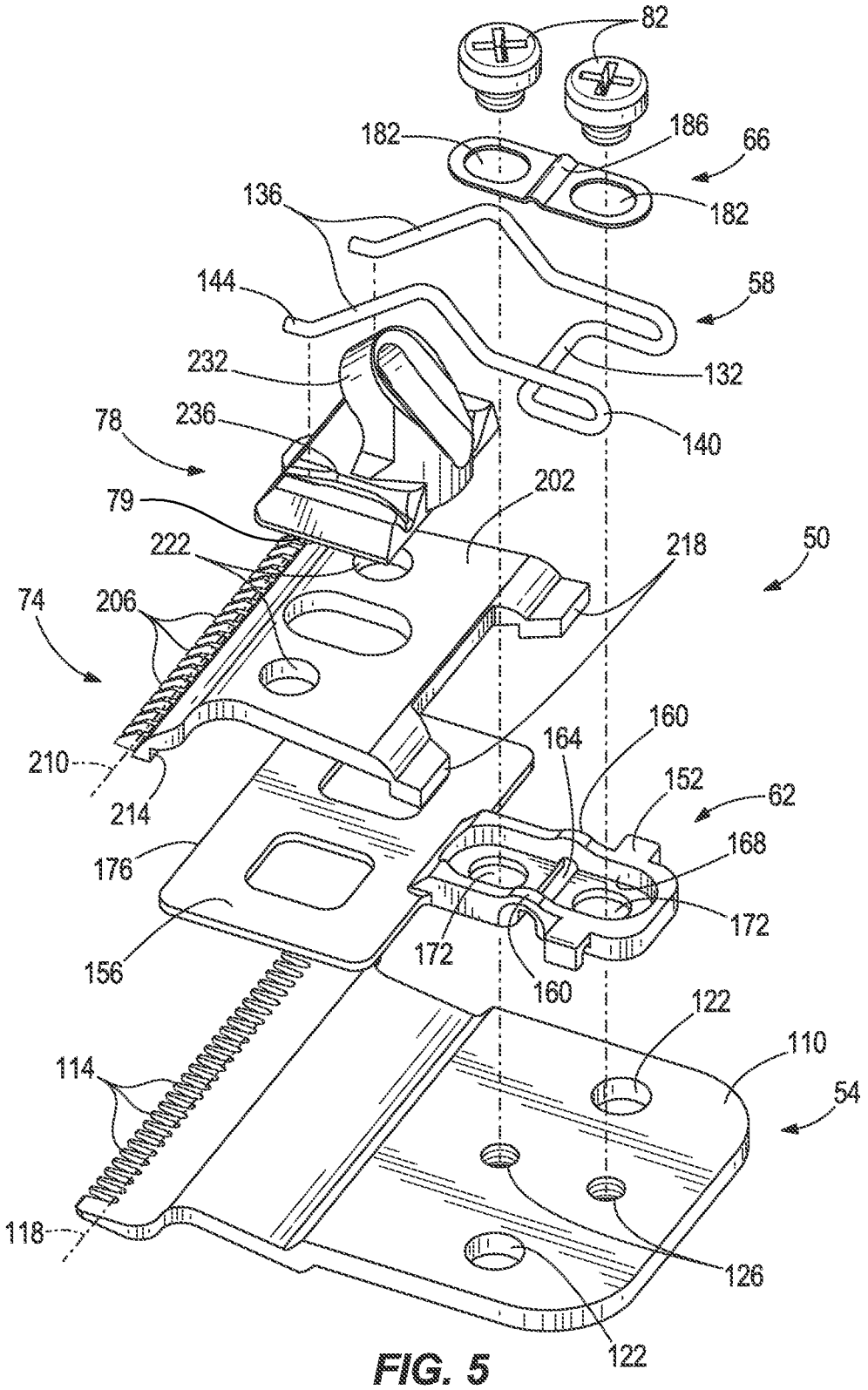
FIG. 5 is an exploded view of the blade assembly.

FIGS. 3-5 illustrate the blade assembly 50, which includes a lower blade 54, a spring 58, a guide 62, a washer 66, an upper blade 74, a yoke 78, and a pair of guide fasteners 82. It will be understood that the hair cutting apparatus 10 may be moved, turned, positioned, and oriented in many different angles and directions during operation. For the purpose of consistency and clarity, positional terms such as up, above, upward, upper, down, below, beneath, downward, lower, front, forward, rear, rearward are used in this detailed description with respect to the operating position of the hair cutting apparatus 10 illustrated in FIG. 1.

The lower blade 54, which can also be referred to as a first blade, includes a main body 110 and a plurality of lower blade teeth 114. The lower blade teeth 114 extend along a nominal lower blade edge 118, which may be defined, for example, by a line connecting the roots of the teeth 114. The lower blade 54 also includes a pair of through-holes 122 for mounting the blade assembly 50 to the housing 14 with the housing fasteners 44, and a pair of threaded holes 126 for receiving the guide fasteners 82.

The spring 58 includes a U-shaped spring base 132 and a pair of spring arms 136 extending generally parallel to each other from the spring base 132. Each spring arm 136 has a fixed end 140 integral with the spring base 132 and a free end 144 coupled to the yoke 78 or upper blade 74. The spring base 132 sits against the main body 110 of the lower blade 54 and is held in place by the guide 62. In this regard, the guide 62 may also be referred to as a spring retainer. The guide 62 fixes the spring base 132 with respect to the lower blade 54 to prevent relative movement between the spring base 132 and the lower blade 54 during reciprocation of the spring arms 136, upper blade 74, and yoke 78 with respect to the lower blade 54.

The guide 62 is a T-shaped piece that is mounted to the lower blade 54 and includes a guide base 152 and a cross portion 156. The guide base 152 includes a pair of arches 160 and an arched tunnel 164, all opening toward the lower blade 54, to accommodate and trap the spring base 132 against the lower blade 54. The guide base 152 therefore incorporates a spring retainer. The guide base 152 includes a washer recess 168 and a pair of slots 172 extending parallel to the major axis of the guide base 152 and perpendicular to the major axis of the cross portion 156. The cross portion 156 includes a guide edge 176 parallel to the lower blade edge 118 when the guide 62 is installed on the lower blade 54. The guide 62 performs two functions: guiding reciprocating movement of the upper blade 74 with the guide edge 176 and retaining the spring 58 against the body 110 of the lower blade 54 with the guide base 152.

The washer 66 sits in the washer recess 168 in the guide base 152. The washer 66 includes a pair of slots 182 that align with the slots 172 in the guide base 152. The washer 66 also includes an arched portion 186 to accommodate the arched tunnel 164 in the guide base 152. The guide fasteners 82 extend through the slots 182, 172 in the washer 66 and guide base 152, respectively, and thread into the threaded holes 126 in the main body 110 of the lower blade 54. With the guide fasteners 82 tightened down against the washer 66 and guide base 152, the spring base 132 is trapped against and fixed with respect to the lower blade 54.

The upper blade 74, which may also be referred to as the second blade, sits on top of the lower blade 54 and guide 62. The guide 62 is sandwiched between the upper and lower blades 74, 54. The upper blade 74 includes a main body 202 and a plurality of upper blade teeth 206. The upper blade teeth 206 extend along a nominal upper blade edge 210, which may be defined, for example, by a line connecting the roots of the teeth 206. The upper blade 74 is positioned proximate the lower blade 54 with the upper blade edge 210 parallel to and offset from the lower blade edge 118. Rearward of the upper blade edge 210, on the bottom side of the upper blade 74, is a depending guide surface 214 that is parallel to the upper blade edge 210 and that engages the guide edge 176. The guide edge 176 restricts movement of the upper blade 74 perpendicular to the lower blade edge 118.

The engagement of the guide surface 214 against the guide edge 176 guides movement of the upper blade 74 parallel to the blade edge 118 of the lower blade 54. This engagement maintains a consistent blade gap 220 (FIGS. 3 and 4) between the parallel upper and lower blade edges 210, 118 as the upper blade 74 reciprocates with respect to the lower blade 54. The blade gap 220 refers to a forward-rearward offset of the blade edges 118, 210 and not a vertical separation; the upper blade teeth 206 are immediately adjacent or proximate the lower blade teeth 114 to perform a shearing function. The guide 62 therefore serves the purpose of maintaining a constant blade gap 220 in addition to fixing the spring base 132 with respect to the lower blade 54.

A pair of feet 218 depend from the rear end of the upper blade body 202. The feet 218 straddle the guide base 152 and sit on the body 110 of the lower blade 54. The feet 218 create a vertical gap between the rear edges of the upper and lower blades 74, 54, such that the guide base 152 can extend rearward through the vertical gap. The distance between the feet 218 provides sufficient room for the upper blade 74 to reciprocate with respect to the lower blade 54 and the guide 62, without the feet 218 hitting the guide base 152. The upper blade body 202 includes a pair of holes 222 for coupling the upper blade 74 with the yoke 78.

The yoke 78 sits on top of the upper blade 74. A pair of pegs 79 depending from the bottom of the yoke 78 are inserted into the holes 222 in the main body 202 of the upper blade 74 so that the yoke 78 is coupled to the upper blade 74. The yoke 78 includes a receiver 232 for receiving the eccentric drive 40 of the drive mechanism 22. The yoke 78 also includes channels or grooves 236 on opposite sides of the receiver 232.

The channels 236 receive the free ends 144 of the spring arms 136, such that the free ends 144 can apply a downward biasing force on the yoke 78 and slide forward and rearward within the channels 236 as the yoke 78 and upper blade 74 reciprocate with respect to the lower blade 54. The yoke 78 is adapted to convert motion of the drive mechanism 22 into reciprocation of the upper blade 74 with respect to the lower blade 54 to cut hair between the teeth 114, 206 of the lower and upper blades 54, 74. In alternative configurations, the spring arms 136 may be coupled at their free ends 144 to the upper blade 74 rather than the yoke 78.

The blade assembly 50 is assembled by stacking the spring 58, guide 62, washer 66, upper blade 74, and yoke 78 on the lower blade 54, and then extending the guide fasteners 82 through the slots 182, 172 of the washer 66 and guide 62 and threading the guide fasteners 82 into the threaded holes 126 in the lower blade 54. The free ends 144 of the spring arms 136 are positioned in the channels 236 of the yoke 78. The spring 58 applies a downward biasing force on the yoke 78 and an upward biasing force on the lower blade 54 to draw the yoke 78 and lower blade 54 toward each other. These biasing forces of the spring 58 sandwich the upper blade 74 between the yoke 78 and lower blade 54. The spring 58 may be characterized as a tension spring because when the blade assembly 50 is assembled, the spring arms 136 and spring base 132 are separated from each other wider than their at-rest position or relationship, and the spring 58 is attempting to draw or pull the spring arms 136 and spring base 132 back to the at-rest position.

The guide fasteners 82 and slots 182, 172 define a range of adjustability for the guide 62 with respect to the lower blade 54, and therefore a range of adjustability for the blade gap 220. The guide 62 may be moved perpendicularly toward the lower blade edge 118 until one of the guide fasteners 82 abuts an end of the slot 182 or 172 in which it is positioned, at which point the guide 62 is prevented by the guide fastener 82 from moving any further in that direction with respect to the lower blade 54. The same is true in the opposite direction, perpendicularly away from the lower blade edge 118—the guide 62 may be move until one of the guide fasteners 82 abuts an end of the slot 182 or 172 in which it is positioned, at which point the guide 62 is prevented from moving any further in such opposite direction with respect to the lower blade 54. The range of adjustability is therefore defined by a guide fastener 82 abutting one end or the opposite end of the slot 182 or 172 in which it resides. It is possible for one fastener 82 to define the limit of forward adjustability and the other fastener 82 to define the limit of rearward adjustability. The position of the guide 62 with respect to the lower blade 54 (and therefore the blade gap 220) can be adjusted by loosening the guide fasteners 82, moving the guide 62 within the range of adjustability, and tightening the guide fasteners 82 when the guide 62 is in a desired position and a desired blade gap 220 is achieved.

The position of the guide 62 corresponds to or defines the width of the blade gap 220 because the guide 62 is fixed with respect to the lower blade 54, and the upper blade 74 reciprocates along the guide edge 176. When the guide 62 is adjusted to the forward limit (FIG. 3) in the range of adjustability, the blade gap 220 is minimized and when the guide 62 is adjusted to the rear limit (FIG. 4) in the range of adjustability, the blade gap 220 is maximized. The blade gap 220 determines the length to which the hair cutting apparatus 10 will cut hair; the smaller the blade gap 220, the shorter the length to which the hair will be cut.

As illustrated in FIGS. 3 and 4, the blade gap 220 can be adjusted with the blade assembly 50 fully assembled. This is because the spring 58 is carried by the lower blade 54 and is held in place with the guide 62, and because the fasteners 82 are accessible while the blade assembly 50 is assembled. The spring arms 136 apply a biasing force on the upper blade 74 and yoke 78 toward the lower blade 54 to maintain the blade assembly 50 in the operational condition when attached to the housing 14 and when it is detached or separated from the housing 14. When detached from the housing 14, the upper blade 74 can be manually reciprocated by one holding the lower blade 54 and moving the upper blade 74 or yoke 78 back and forth parallel to the blade edges 118, 210. When attached to the housing 14, the lower blade 54 is fixed with respect to the housing 14 and the yoke 78 receives the eccentric drive 40, which drives reciprocation of the yoke 78 and upper blade 74 with respect to the lower blade 54.

Once assembled and adjusted to a desired blade gap 220, the blade assembly 50 is attached to the housing 14 with the housing fasteners 44. As the blade assembly 50 is aligned with the mounting holes on the housing 14 so that the housing fasteners 44 can be threaded into the housing, the eccentric drive 40 aligns with and is received within the receiver 232. When the motor 18 is energized, the eccentric drive 40 orbits around the motor output shaft axis of rotation 36. The orbital movement of the eccentric drive 40 is converted into translational (specifically, reciprocating) movement of the yoke 78 and upper blade 74 with respect to the lower blade 54 (which is held stationary with respect to the housing 14 by the housing fasteners 44).

As the yoke 78 and upper blade 74 reciprocate with respect to the lower blade 54, the spring base 132 is fixed with respect to the lower blade 54 and the spring arms 136 wave back and forth in parallel with each other. More specifically, the fixed ends 140 of the spring arms 136 remain substantially fixed with respect to the lower blade 54, the spring arms 136 pivot about the fixed ends 140 during reciprocation of the upper blade 74 and yoke 78, and the free ends 144 describe arcs. The arcuate movement of the free ends 144 is converted into translational movement of the yoke 78 and upper blade 74 as the free ends 144 are free to move forward and rearward in the channels 236 with respect to the yoke 78, but are restrained from moving side-to-side within the channels 236. In other words, the channels 236 couple the free ends 144 and the yoke 78 for side-to-side movement, but decouple the free ends 144 from the yoke 78 for relative forward and rearward movement.

The spring arms 136 are of sufficient length (measured from the fixed ends 140 to the free ends 144) to accommodate the full range of reciprocating motion of the upper blade 74 and yoke 78 with respect to the lower blade 54. In known configurations, the spring arms are typically relatively short because of the positioning of the spring base in the blade assembly, and the spring often requires compliance coils in the base or arms to accommodate some of the reciprocating motion. The present invention requires no compliance coil in the spring base 132 or in the spring arms 136 to accommodate reciprocation of the upper blade 74 with respect to the lower blade 54.

The blade gap 220 is adjusted by removing the housing fasteners 44, adjusting the blade gap 220, and reattaching the blade assembly 50 to the housing 14 with the housing fasteners 44. The upper blade 74 and yoke 78 move with respect to the lower blade 54 in response to movement of the spring 58 and guide 62 with respect to the lower blade 54. Because the spring 58, upper blade 74, and yoke 78 are movable with the guide 62, while the blade assembly 50 is maintained in the operational condition, the operator can see the actual blade gap 220 during the adjustment. This is distinguished from known configurations in which the upper blade is not maintained on the lower blade when the lower blade is removed from the housing, and in which the operator must therefore guess at the actual blade gap 220 setting when adjusting the guide on the lower blade. The operator using such known configurations is not certain of what the actual blade gap 220 will look like until the blade assembly is actually reassembled (often by reattaching the lower blade to the rest of the blade assembly that is still connected to the housing).

Thus, the invention provides, among other things, a blade assembly having an entrapped spring to hold the upper and lower blades in an operational condition and an adjustable guide member for adjusting the blade gap while the upper and lower blades are held in the operational condition. Various features and advantages of the invention are set forth in the following claims.

What is claimed is:

1. A blade assembly for a hair cutting apparatus comprising:

a lower blade having teeth extending along an edge of the lower blade;

an upper blade having teeth extending along an edge of the upper blade;

a yoke coupled to the upper blade to reciprocate the upper blade;

a spring having a spring base and a spring arm, wherein the spring includes a semi-circular arc portion; and a spring retainer comprising a guide base, wherein the spring retainer retains the spring against the lower blade;

wherein the upper blade further comprises a depending surface in the upper blade that is offset from and faces away from the edge of the upper blade, the depending surface interfacing against the spring retainer to guide the upper blade over the spring retainer.

2. The blade assembly of claim 1, wherein the spring retainer further comprises a cross-portion extending parallel to the edge of the lower blade, and wherein the guide base retains the spring base and extends from the cross-portion perpendicular to the edge of the lower blade.

3. The blade assembly of claim 2, wherein the spring base is entrapped, and wherein the spring arm and the spring retainer hold the lower and the upper blades in an operational condition such that adjustment of the spring retainer adjusts a gap between the edges of the lower and the upper blades while the upper and the lower blades are held in the operational condition.

4. The blade assembly of claim 2, wherein the cross-portion is captured between the lower blade and the upper blade, and wherein the spring retainer captures the spring base against the lower blade.

5. The blade assembly of claim 4, wherein the spring retainer has a T-shape defined by the guide base and the cross-portion.

6. The blade assembly of claim 5, further comprising an arch in the guide base of the spring retainer, wherein the arch retains the spring base against the lower blade.

7. The blade assembly of claim 1, wherein the spring arm extends through a channel of the yoke and couples to the upper blade, wherein the spring arm reciprocates with the upper blade.

8. The blade assembly of claim 7, wherein the yoke, the spring arm, and the upper blade reciprocate over the lower blade, a cross-portion of the spring retainer, and the spring base.

9. The blade assembly of claim 1, further comprising a peg protruding from a bottom surface of the yoke, the peg being received in an aperture of the upper blade.

10. The blade assembly of claim 9, wherein the peg received in the aperture couples the yoke to the upper blade.

11. A blade assembly for a hair cutting apparatus, the blade assembly comprising:

a lower blade having teeth extending along an edge of the lower blade;

an upper blade having teeth extending along an edge of the upper blade;

a yoke having a channel, the yoke coupled to the upper blade to reciprocate the upper blade;

an arcuate shaped spring having a spring base and a spring arm, wherein the spring arm is coupled to the channel of the yoke, wherein the arcuate shaped spring has a coil with a semi-circular arc portion, and wherein the spring base is positioned above the lower blade; and a spring retainer comprising a guide base, wherein the spring retainer retains the arcuate shaped spring against the lower blade;

wherein the upper blade further comprises a depending surface in the upper blade that is offset from and faces away from the edge of the upper blade, the depending surface interfacing against the spring retainer to guide the upper blade over the spring retainer.

12. The blade assembly of claim 11, further comprising a peg protruding from a bottom surface of the yoke, the peg being received in an aperture of the upper blade to couple the yoke to the upper blade.

13. The blade assembly of claim 11, wherein the spring retainer is T-shaped and includes a cross-portion oriented perpendicular to the guide base, wherein the cross portion is captured between the lower and the upper blades and the guide base retains the spring base against the lower blade.

14. The blade assembly of claim 11, wherein the spring retainer is fastened to the lower blade.

15. The blade assembly of claim 11, wherein the spring arm extends through the channel of the yoke and terminates in a free end, wherein the spring arm reciprocates with the upper blade.

16. The blade assembly of claim 15, wherein the free end applies a downward biasing force on the yoke and slides forward and rearward within the channel as the yoke and the upper blade reciprocate with respect to the lower blade.

17. The blade assembly of claim 16, wherein movement of the free end defines an arc in response to reciprocation of the upper blade over the lower blade.

18. A blade assembly for a hair cutting apparatus, the blade assembly comprising:

a lower blade having teeth extending along an edge of the lower blade;

an upper blade having teeth extending along an edge of the upper blade;

a yoke having a channel, the yoke coupled to the upper blade to reciprocate the upper blade;

an arcuate shaped spring having an arcuate shape between a spring base and a spring arm, wherein the spring arm is coupled to the channel of the yoke, the spring arm extending through the channel to form a free end of the spring arm, wherein the arcuate shape couples the spring base to the spring arm such that the arcuate shaped spring has a portion which is shaped as a semi-circular arc, and wherein the spring base is positioned above the lower blade; and a spring retainer comprising a guide base, wherein the spring retainer retains the arcuate shaped spring against the lower blade;

wherein the upper blade further comprises a depending surface in the upper blade that is offset from and faces away from the edge of the upper blade, the depending surface interfacing against the spring retainer to guide the upper blade over the spring retainer.

19. The blade assembly of claim 18, wherein the spring arm slides forward and rearward within the channel as the yoke and the upper blade reciprocate with respect to the lower blade.

* * * * *